US009907394B2

(12) United States Patent
Frankel et al.

(10) Patent No.: US 9,907,394 B2
(45) Date of Patent: Mar. 6, 2018

(54) FOLDING TABLE

(71) Applicant: Zenithen USA LLC, Diamond Bar, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA LLC, Diamond Bar, CA (US)

( * ) Notice: Subject to any disclaimer, the term of this patent is extended or adjusted under 35 U.S.C. 154(b) by 0 days.

(21) Appl. No.: 14/820,595

(22) Filed: Aug. 7, 2015

(65) Prior Publication Data

US 2017/0035194 A1 Feb. 9, 2017

(51) Int. Cl.

| | |
|---|---|
| ***A47B 5/00*** | (2006.01) |
| ***A47B 3/087*** | (2006.01) |
| *A47B 43/00* | (2006.01) |

(52) U.S. Cl.

CPC ..... *A47B 3/087* (2013.01); *A47B 43/003* (2013.01)

(58) Field of Classification Search

CPC ..... A47B 3/00; A47B 3/14; A47B 83/02
USPC ..... 108/166–170, 173–175
See application file for complete search history.

(56) References Cited

U.S. PATENT DOCUMENTS

| | | | | | |
|---|---|---|---|---|---|
| 3,143,982 | A * | 8/1964 | Blink | A47B 3/087 | 108/130 |
| 3,276,401 | A * | 10/1966 | Wilson | A47B 3/087 | 108/169 |
| 3,999,491 | A * | 12/1976 | Wilson | E04H 3/28 | 108/175 |
| 4,157,089 | A * | 6/1979 | Loughrey | A61G 13/105 | 108/116 |
| 5,613,450 | A * | 3/1997 | Wagner | E04H 3/28 | 108/170 |
| 6,024,026 | A * | 2/2000 | Botts | E04H 3/28 | 108/170 |
| 9,526,327 | B1 * | 12/2016 | Lin | A47B 3/087 | |

* cited by examiner

*Primary Examiner* — Matthew W Ing
(74) *Attorney, Agent, or Firm* — Merek, Blackmon & Voorhees, LLC

(57) ABSTRACT

A folding table includes a first table top and a second table top that can move between a folding position and an unfolding position, as well as a first and second table leg component for supporting the second table top, wherein two sets of mutually hinged four-link mechanisms are formed by the first and second table leg component in virtue of table beams, table legs and inclined rods. The two sets of four-link mechanisms realize interference self-locking in the unfolding process. Two triangles are formed for supporting a table top stably, and the stress is uniform. The table top can be folded face to face in two parts, so that the table top after being folded is effectively protected, and scratches on the table top during the production, transportation and using processes are reduced.

12 Claims, 9 Drawing Sheets

FOLDING TABLE

BACKGROUND OF THE INVENTION

Field of the Invention

The present invention is in the field of folding furniture, and particularly relates to a folding table, especially a folding table which includes a table top capable of being folded and put away face to face in two parts.

Background of the Invention

Most folding tables at present are folded in the manner that a the table top faces outwards, namely two half parts of the table top face outwards after the table is folded, so that the damage of the table tops can be readily caused during the transportation or storage process. For example, a portable folding table in CN100593379C includes a table top and table leg components. The table top is formed in a blow-molding mode and is divided into two half parts, and the first half part and the second half part are connected through a pivot shaft and can move between an unfolding position and a folding position around the pivot shaft. The table leg components can move between the folding position and the unfolding position relative to the table top. The table leg components comprise table legs positioned at the two ends of the table top through connecting rods and supporting rods for maintaining the table legs to be unfolded, one end of each of the supporting rods is detachably positioned in the middle of each of the table legs, and the other ends of the supporting rods are detachably positioned on brackets on the back of the table top. The folding table is mainly used for replacing a traditional domestic table or banquet table. The troublesome operation of folding or unfolding is acceptable, but the two half parts of the table top face outwards after the table is folded and need to be protected during the transportation, storage and collection processes, otherwise the table top is easily impacted or scratched.

The folding table in CN102511986B comprises a symmetrically foldable table top and foldable table legs, where the two half parts of the table top are connected at the folding position of the table top through a folding locking device. The folding locking device consists of a folding connecting mechanism at the folding position that the table top is connected and a locking mechanism mounted under the folding position of the table top. Folding hinges are arranged on the inner sides of the folding positions of the table legs, and table leg fastening devices are arranged on the outer sides of the table legs. The table top and the table legs of the folding table are respectively foldable. The folding table can be vertically placed after being folded, so that the folding table is small in occupied space, convenient to transport, safer and more reliable. The table top folding mechanism and the table leg folding mechanism of the folding table are independent mechanisms, and face-to-face folding of the two half parts of the table top can be realized for protecting the table top, but the operation is relatively troublesome.

The two above-mentioned folding tables are respectively suitable for indoor environments with seldom folding operation, but are difficult to expand on outdoor occasions. How to design a folding table which is convenient in folding and unfolding operations and also can protect the table top becomes an object of the present invention.

SUMMARY OF THE INVENTION

The present invention according to at least one aspect shows a folding table that a table top can be folded face to face and the unfolding and folding operations of the table top and table legs are continuous.

The technical scheme of the present invention is realized in part as follows: the folding table, comprises:

a first table top and a second table top which can move between a folding position and an unfolding position; as well as a first table leg component for supporting the first table top and a second table leg component for supporting the second table top; characterized in that the first table leg component consists of or comprises the same or symmetrical structures of parts distributed on the two sides of the first table top to support the first table top, and comprises first table beams, first table legs and first inclined rods for positioning and supporting the first table top;

the second table leg component consists of or comprises the same or symmetrical structures of parts distributed on the two sides of the second table top to support the second table top, and comprises second table beams, second table legs and second inclined rods for positioning and supporting the second table top;

the first table beams and the second table beams are mutually staggered, the first table beams extend towards one side of each of the second table beams to form first extending sections, and the second table beams extend towards one side of each of the first table beams to form second extending sections; the first extending sections and the second extending sections at the staggered positions are hinged through shaft members;

the upper ends of the first table legs are hinged onto the first table beams, one end of each of the first inclined rods is hinged onto the first table legs, and the other ends of the first inclined rods are hinged to the ends of the second extending sections; a first set of four-link mechanisms composed of the first table beams, a part of the first table legs, the first inclined rods and the second extending sections are unfolded in place to support the first table top in virtue of the second extending sections and the first table beams, and the first table leg component is folded to the back of the first table top at the folding position;

the upper ends of the second table legs are hinged onto the second table beams, one end of each of the second inclined rods is hinged onto the second table legs, and the other ends of the second inclined rods are hinged to the ends of the first extending sections; a second set of four-link mechanisms composed of the second table beams, a part of the second table legs, the second inclined rods and the first extending sections are unfolded in place to support the second table top in virtue of the first extending sections and the second table beams, and the second table leg component is folded to the back of the second table top at the folding position.

Further, the first extending sections and the second extending sections are plastically molded respectively, correspondingly called first plastic parts and second plastic parts. Shaft holes and shaft grooves with upward openings are respectively formed in the first plastic parts and the second plastic parts; each shaft member is of a double-shaft structure, and comprises a first shaft and a second shaft which are connected through a connecting shaft seat. The ends of the first shaft are inserted in the shaft holes of the first plastic parts, and the first shaft can flexibly enter the shaft grooves of the second plastic parts partially to form ascending limit of the second plastic parts. The second shaft is inserted in the shaft holes of the second plastic parts, and the second shaft can flexibly enter the shaft grooves of the first plastic parts partially to form ascending limit of the first plastic parts.

The first shafts and the second shafts of the shaft members are respectively through shafts, the shaft members are provided with at least two connecting shaft seats, the first shaft runs through the first plastic parts on the two sides, and the second shaft runs through the second plastic parts on the two sides.

Further, the first extending sections and the second extending sections are plastically molded respectively, correspondingly called the first plastic parts and the second plastic parts. The shaft holes and the shaft grooves with the upward openings are respectively formed in the first plastic parts and the second plastic parts. The shaft members are through shafts, and the two ends of each shaft member respectively run through the shaft holes of the first plastic parts and the second plastic parts on the two sides. convex pins are arranged at the positions, corresponding to the shaft grooves of the second plastic parts, of the first table beams to form ascending limit of the second plastic parts, Convex pins are arranged at the positions, corresponding to the shaft grooves of the first plastic parts, of the second table beams to form ascending limit of the first plastic parts.

Two to three trays are fixed on the through shafts. One tray is arranged close to the first plastic parts. Support pins are arranged on the side, facing the tray, at the tilting ends of the first plastic parts. The table top is unfolded in place to support one side of the tray in virtue of the support pins. The other tray is arranged close to the second plastic parts. Support pins are arranged on the side, facing the tray, at the tilting ends of the second plastic parts. The table top is unfolded in place to support the other side of the tray in virtue of the support pins. During the unfolding and tilting process of the first plastic parts and the second plastic parts, the trays are centralized and also support the back of the contact part of the first table top and the second table top.

Further, a lock catch component is arranged between each first plastic part and each second plastic part. The lock catch components are unfolded in place on the first table top and the second table top to form an opposite pulling structure for the first plastic parts and the second plastic parts. The first plastic parts and the second plastic parts are prevented from being staggered in horizontal direction.

Each lock catch component comprises an operating piece with a handle and a connecting piece. one end of the operating piece is hinged onto the second plastic part, the middle part of the operating piece is hinged with one end of the connecting piece, and a convex point is arranged on the side, facing the connecting piece, at the other end of the operating piece; One end of the connecting piece is hinged onto the first plastic part. The other end of the connecting piece is hinged onto the operating piece, and a buckle hole corresponding to the convex point on the operating piece is arranged at the middle part of the connecting piece. The table top is unfolded in place, and the handles on the two sides are lifted simultaneously so that the convex points on the operating pieces slip into the buckle holes to form a lock catch relationship.

Further, the first table beams are a part of the first table top, and are reinforcing ribs distributed on the two sides of the back of the first table top. The second table beams are a part of the second table top, and are reinforcing ribs distributed on the two sides of the back of the second table top.

Further, the first table legs and the second table legs are bent U-shaped rod pieces, and the two ends of each of the U-shaped rod pieces are correspondingly hinged onto the first table beams on the two sides of the first table top and the second table beams on the two sides of the second table top.

A folding storage hanging bag hangs on the lower side of the first table beams, or folding storage hanging bags hang on the lower sides of the first table beams and the second table beams.

The folding table has the characteristics of smart design, face-to-face foldability of the table top and continuous and smooth operation. Two sets of mutually hinged four-bar mechanisms are formed by the table leg components in virtue of the table beams, the table legs and the inclined rods. The two sets of four-link mechanisms realize interference self-locking in the unfolding process. Two relevance triangles are formed for supporting the table top stably, and the stress is uniform. The table top is related too the table legs, the motions in the folding process are continuous, and the two half parts of the table top can be folded face to face so that the table top after being folded is effectively protected, and scratches on the table top during the production, transportation and using processes are reduced.

BRIEF DESCRIPTION OF THE DRAWINGS

The following further describes the present invention with reference to the following specific drawings.

Figure 1:
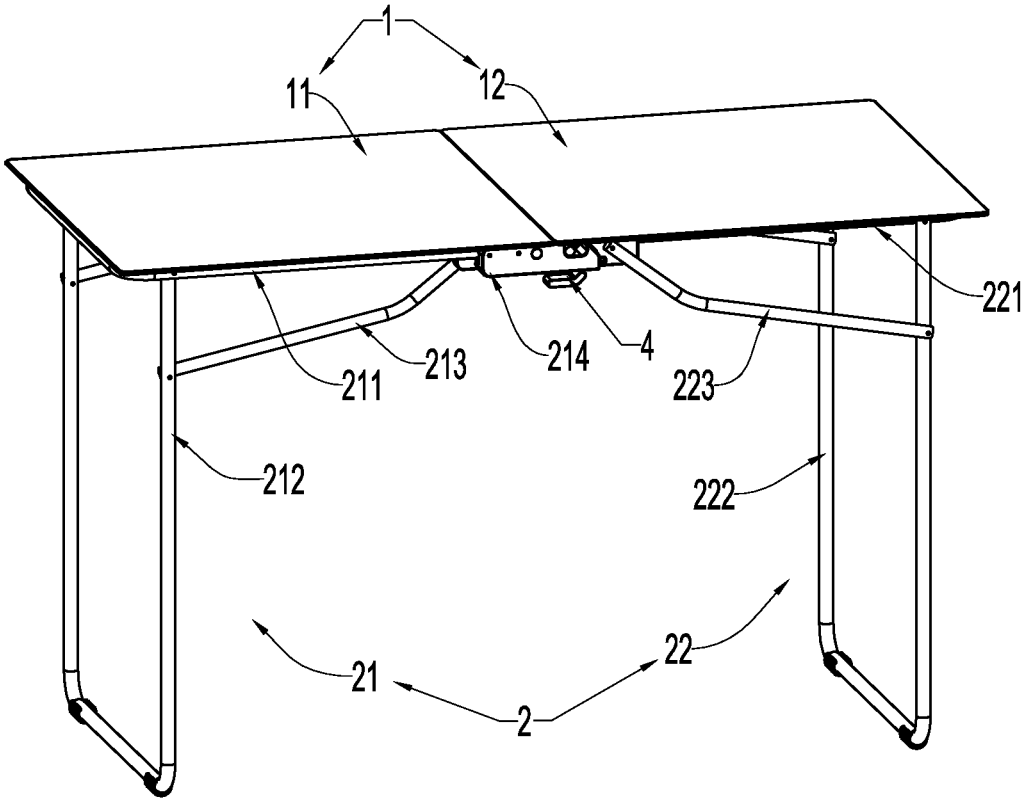
FIG. 1 is a space diagram of a folding table.
Figure 2:
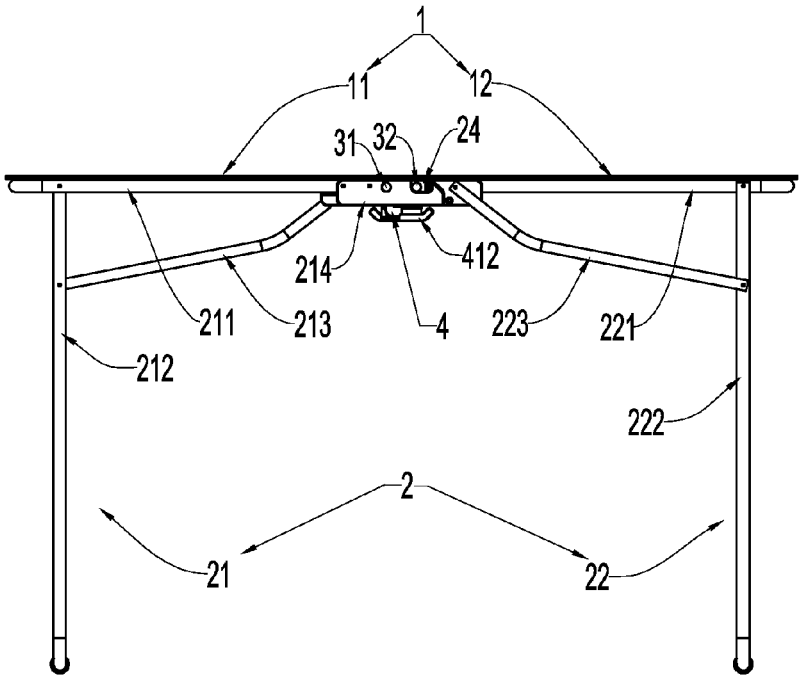
FIG. 2 is a side diagram of the folding table.
Figure 3:
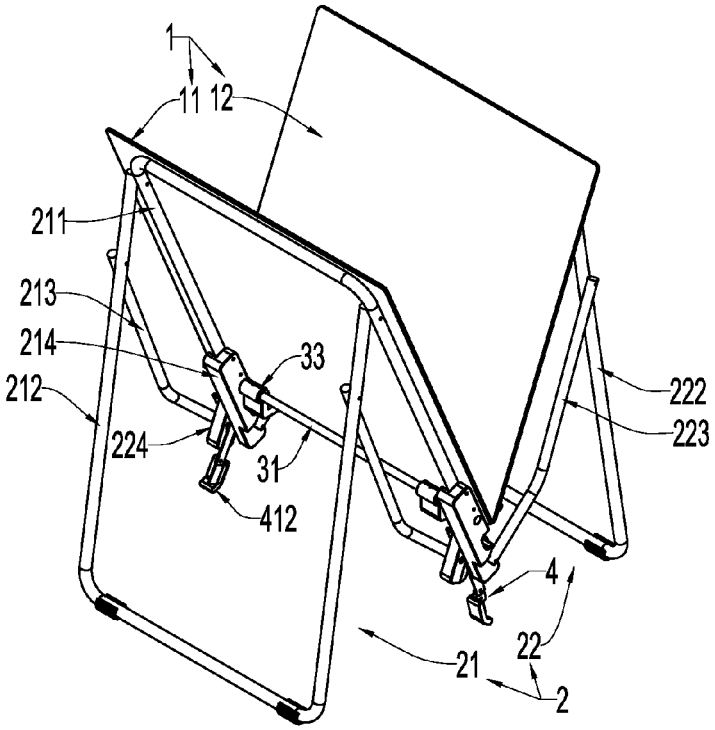
FIG. 3 is a diagrammatic drawing of the folding process of the folding table.

Wherein the components of the drawings are as follows:

TABLE 1

| | | | |
|---|---|---|---|
| 1-table top | 11-first table top | 12-second table top | 2-table leg component |
| 21-first table leg component | 211-first table beam | 212-first table leg | 213-first inclined rod |
| 214-first plastic part | 22-second table leg component | 221-second table beam | 222-second table leg |
| 223-second inclined rod | 224-second plastic part | 23-shaft hole | 24-shaft groove |
| 25-convex pin | 26-support pin | 3-shaft member | 31-first shaft |
| 32-second shaft | 33-connecting shaft seat | 330-concave part | 34-through shaft |
| 35-tray | 4-lock catch component | 41-operating piece | 411-convex point |

TABLE 1-continued

| | | | |
|---|---|---|---|
| 412-handle | 42-connecting piece | 421-buckle hole | 5-storage hanging bag |
| 6-skirt edge | 61-woven tape | 62-crack | 63-elastic band |

DESCRIPTION OF EMBODIMENTS

First Embodiment

Referring to FIG. 1 to FIG. 6, a folding table comprises a table top 1 and a table leg component 2. The table top 1 consist of or comprises a first table top 11 and a second table top 12 and can move between a folding position and an unfolding position. In particular, face-to-face ("face on") foldability of the two half parts of the table top can be realized. The table leg component 2 comprises a first table leg component 21 for supporting the first table top 11 and a second table leg component 22 for supporting the second table top 12; wherein:

The first table leg component 21 consists of or comprises the same or symmetrical structures of parts distributed on the two sides of the first table top 11 to support the first table top 11, and comprises first table beams 211, first table legs 212 and first inclined rods 213 for positioning and supporting the first table top 11 in virtue of the first table beams 211. More specifically, the first table beams 211 can be a part of the first table top 11, and are reinforcing ribs distributed on the two sides of the back of the first table top 11. The separation structure of the first table beams 211 and the first table top 11 is shown in the figures.

The second table leg component 22 consists of or comprises the same or symmetrical structures of parts distributed on the two sides of the second table top 12 to support the second table top 12, and comprises second table beams 221, second table legs 222 and second inclined rods 223 for positioning and supporting the second table top 12 in virtue of the second table beams 221. More specifically, the second table beams 221 can be a part of the second table top 12, and are reinforcing ribs distributed on the two sides of the back of the second table top 12. The separation structure of the second table beams 221 and the second table top 21 is shown in the figures.

The first table beams 211 and the second table beams 221 are mutually staggered. The first table beams 211 extend towards one side of each of the second table beams 221 to form first extending sections, and the first extending sections are plastically molded and are called first plastic parts 214 in order to facilitate machining and molding. The second table beams 221 extend towards one side of each of the first table beams 211 to form second extending sections, and the second extending sections are plastically molded and are called second plastic parts 224. The first extending sections and the second extending sections at the staggered positions. Namely, the first plastic parts 214 and the second plastic parts 224 are hinged through shaft members 3, so that the first table beams 211 and the second table beams 221 form a relevant body. Namely, the first table top 11 and the second table top 12 are hinged through the shaft members of the first plastic parts 214 and the second plastic parts 224 to form a whole body related to the table top 1. The table top 1 can also be unfolded and folded face to face at the hinged positions of the shaft members.

Figure 4:
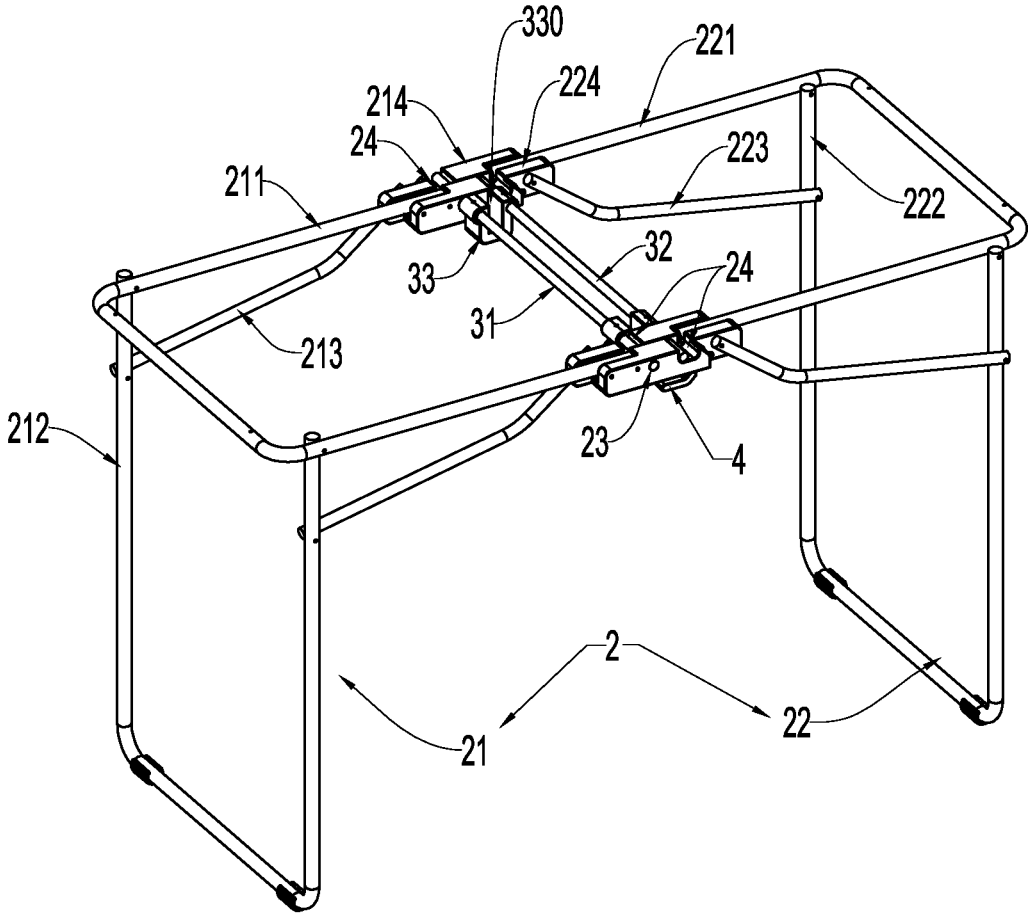
FIG. 4 is a space diagram of table leg components.
Figure 5:
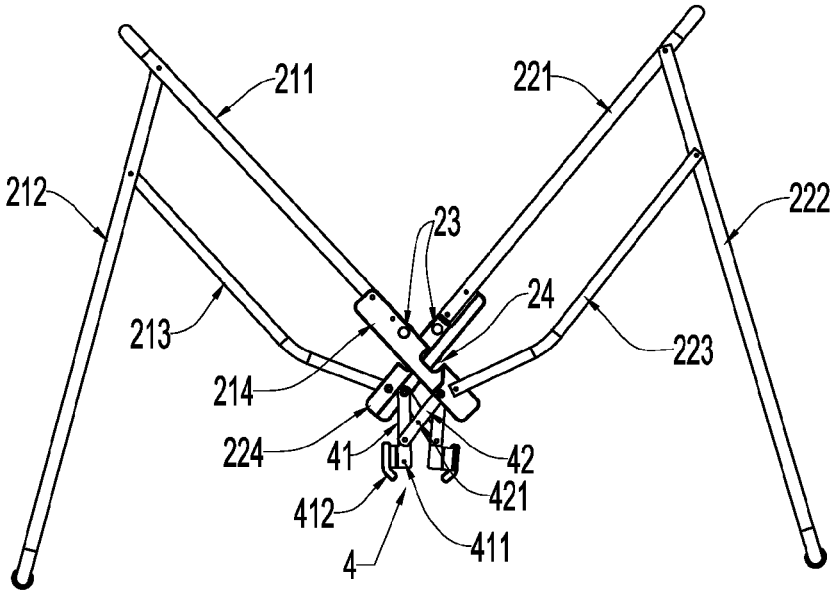
FIG. 5 is a side diagram of the folding process of the table leg components.
Figure 6:
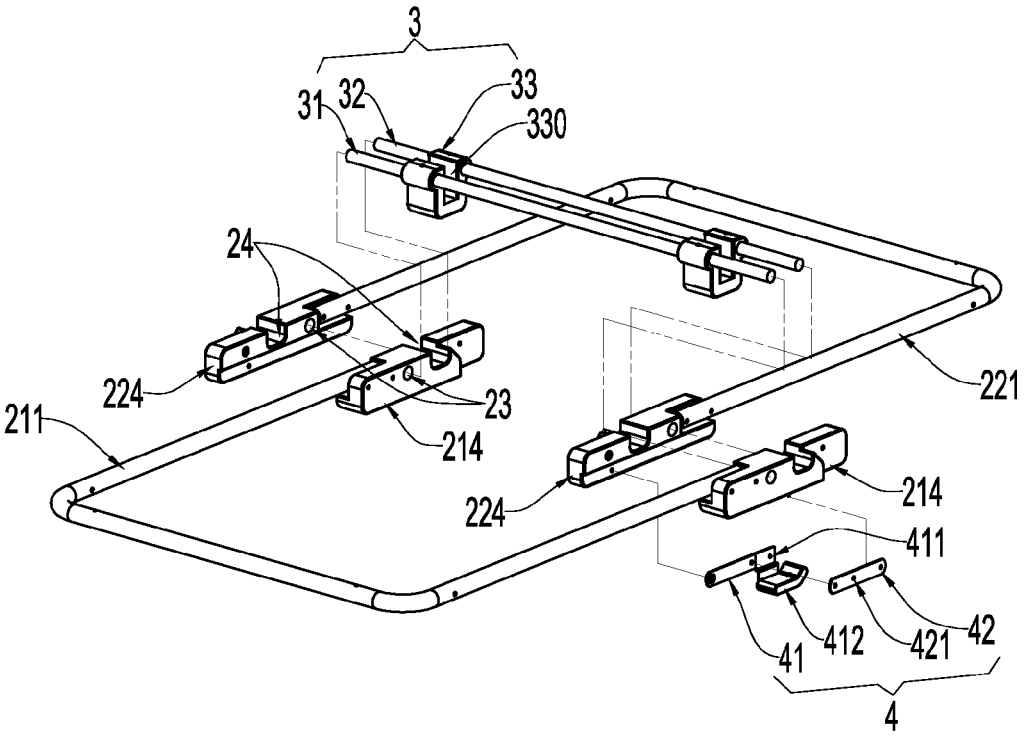
FIG. 6 is a decomposition diagram of the relationship between table beams and shaft members.

The table leg component comprises the following parts:

The upper ends of the first table legs 212 are hinged onto the first table beams 211. One end of each of the first inclined rods 213 is hinged onto the first table legs 212. The other ends of the first inclined rods 211 are hinged to the ends of the second extending sections, namely, the second plastic parts 224. A first set of four-link mechanisms composed of the first table beams 211, a part of the first table legs 212, the first inclined rods 213 and the second plastic parts 224 as shown in FIG. 5 are unfolded in place to support the first table top 11 in virtue of the second plastic parts 224 and the first table beams 211. The first table leg component 21 is folded to the back of the first table top 11 at the folding position as shown in FIG. 4;

Similarly, the upper ends of the second table legs 222 are hinged onto the second table beams 221. One end of each of the second inclined rods 223 is hinged onto the second table legs 222. The other ends of the second inclined rods 221 are hinged to the ends of the first extending sections, namely, the first plastic parts 214. A second set of four-link mechanisms composed of the second table beams 221, a part of the second table legs 222, the second inclined rods 223 and the first plastic parts 214 are unfolded in place to support the second table top 12 in virtue of the first plastic parts 214 and the second table beams 221. The second table leg component 22 is folded to the back of the second table top 12 at the folding position;

In the unfolding process as sown in FIG. 4 and FIG. 5, the first table beams 211 and the second table beams 221 are gradually parallel and level. When the first table beams 211 and the second table beams 221 are parallel and level, the two formed relevant four-bar mechanisms realize interference interlocking due to the first table leg component 21 and the second table leg component 22. The first table leg component 21 and the second table leg component 22 are correspondingly converted into the first table legs 212, the first inclined rods 213 and the first table beams 211, as well as the second table legs 222, the second inclined rods 223 and the second table beams 221 to form two triangular supports. The interference upward shaking force directions of the first plastic parts 213 and the second plastic parts 224 are opposite to the bearing force direction of the table top 1 so as to stably support the table top 1.

In order to prevent the first plastic parts 214 and the second plastic parts 224 from being lifted upwards by people excessively during the unfolding operation of the table top 1, the first plastic parts 214 and the second plastic parts 224 go upwards continuously after exceeding designed interference points so as to further design ascending limit of the first plastic parts 214 and the second plastic parts 224. The specific structures are as follows: shaft holes 23 and shaft grooves 24 with upward openings are respectively formed in the first plastic parts 214 and the second plastic parts 224; each shaft member 3 is of a double-shaft structure, and comprises a first shaft 31 and a second shaft 32, which are connected through a connecting shaft seat 33. The ends of the first shaft 31 are inserted in the shaft holes 23 of the first plastic parts 214, and the first shaft 31 can flexibly enter the shaft grooves 24 of the second plastic parts 224 partially to form ascending limit of the second plastic parts 224. The second shaft 32 is inserted in the shaft holes 23 of the second plastic parts 224, and the second shaft 32 can flexibly enter the shaft grooves 24 of the first plastic parts 214 partially to form ascending limit of the first plastic parts 214. In this way, the table top is unfolded in place to realize a mutual limiting structure.

Further, the first shafts 31 and the second shafts 32 of the shaft members 3 are respectively through-shafts. The shaft members are provided with at least two connecting shaft seats 33. The first shaft 31 runs through the first plastic parts 214 on the two sides, and the second shaft 32 runs through the second plastic parts 224 on the two sides. The design of the through shafts can improve the rigidity strength of the table beams and the table legs components on the two sides. Assuredly, the scheme of short shafts is acceptable, namely the first shafts 31 and the second shafts 32 are short shafts, and are fixed to form the whole body of the shaft members 3 through the connecting shaft seats 33. A shaft member 3 is respectively used on the two sides of the table top, and the coaxiality exists on the two sides. In order to avoid a descending space at the connecting part when the first table top 11 and the second table top 12 are folded, a concave part 330 can be designed on each connecting shaft seat 33, and the concave part 330 can accommodate the thicknesses of the two table tops.

In the embodiment, the shaft members 3 are double-shaft structures, and the concave parts 330 of the connecting shaft seat 33 are provided so as to adapt the use of a thicker table top 1 and meet the scheme of folding tables at courtyards, banquets or on solemn occasions.

Further, in order to prevent the two ends of the table top 1 from being raised accidentally, the table top is at a folding inclined trend, an unfolding in-place lock catch component 4 is arranged between each first plastic part 214 and each second plastic part 224. Each lock catch component 4 comprises an operating piece 41 and a connecting piece 42. One end of the operating piece 41 is hinged onto the second plastic part 224. The middle part of the operating piece is hinged with one end of the connecting piece 42, and a convex point 411 is arranged on the side, facing the connecting piece 42, at the other end of the operating piece, and a handle 412 is further arranged at the end. One end of the connecting piece 42 is hinged onto the first plastic part 214; the other end of the connecting piece is hinged onto the operating piece 41. And a buckle hole 421 corresponding to the convex point 411 on the operating piece is arranged at the middle part of the connecting piece. The table top is unfolded in place, and the handles 412 on the two sides are lifted simultaneously, so that the convex points 411 on the operating pieces 41 slip into the buckle holes 421 to form a lock catch relationship. The lock catch relationship is substantially an opposite pulling relationship. When the two sets of four-link mechanisms of the table leg component are converted into folding positions from the unfolding positions, the first plastic parts 214 and the second plastic parts 224 pass the interference points to cause staggering in the horizontal direction. The unfolding state of the table leg component is reliably locked as long as the first plastic parts 214 and the second plastic parts 224 are prevented from being staggered.

Moreover, the lock catch components 4 also provide operation reference for the conversion of folding and unfolding of the folding table. At the beginning of unfolding, the distal ends of the first table top 11 and the second table top 12 are pulled out with two hands. A certain angle is then opened, the double hands move is to the position of the handles 412 on the two sides. The handles 412 on the two sides are lifted simultaneously until the convex points slip into the buckle holes 412 to reach the lock catch positions, and the table top is exactly positioned at the unfolding position at that time. Opposingly, the handles 412 on the two sides are pressed simultaneously, the convex points 411 slip out of the locking positions of the buckle holes 421, and the first plastic parts 214 and the second plastic parts 224 are pulled to pass the interference points of the four-bar links to realize folding actions.

Further, the first table legs 212 and the second table legs 222 are bent U-shaped rod pieces, and the two ends of each of the U-shaped rod pieces are correspondingly hinged onto the first table beams 211 on the two sides of the first table top 11 and the second table beams 221 on the two sides of the second table top 12, so that the rigidity strength of the table legs is improved, and further machining such as extra welding is not needed. In this way, the structure of cross bars can be additionally arranged between the table legs on the two sides.

Second Embodiment

Figure 7:
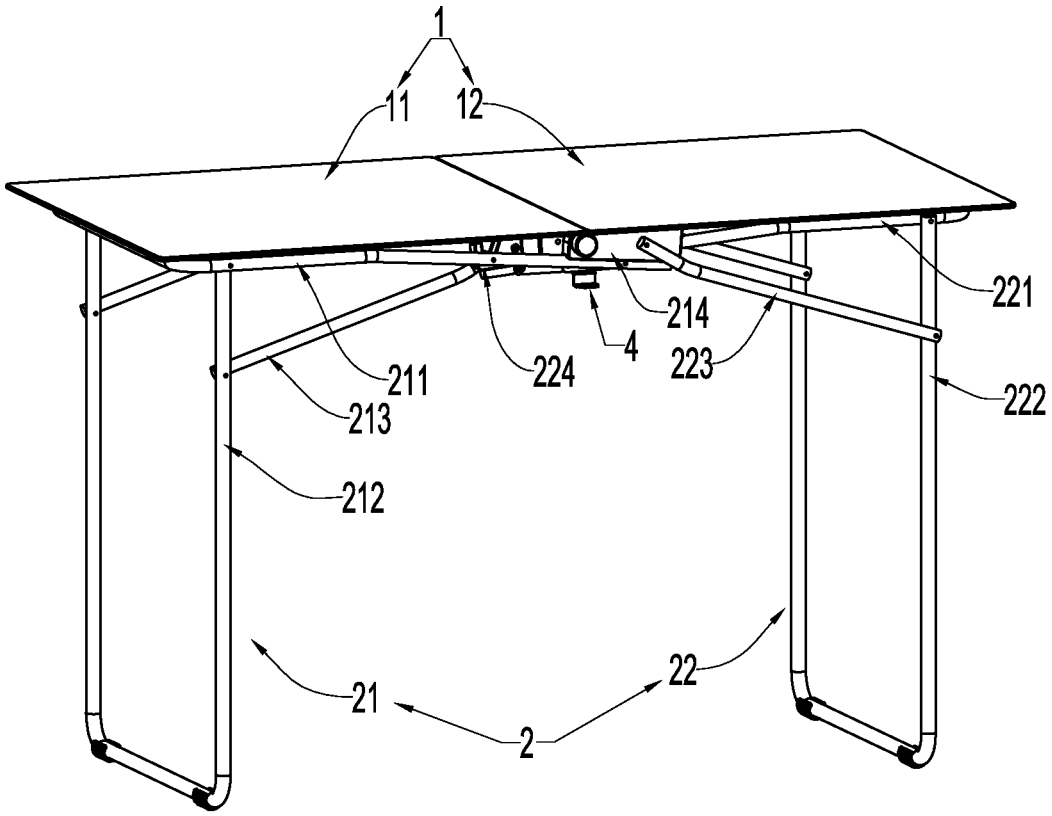
FIG. 7 is a space diagram of an outdoor folding table.
Figure 8:
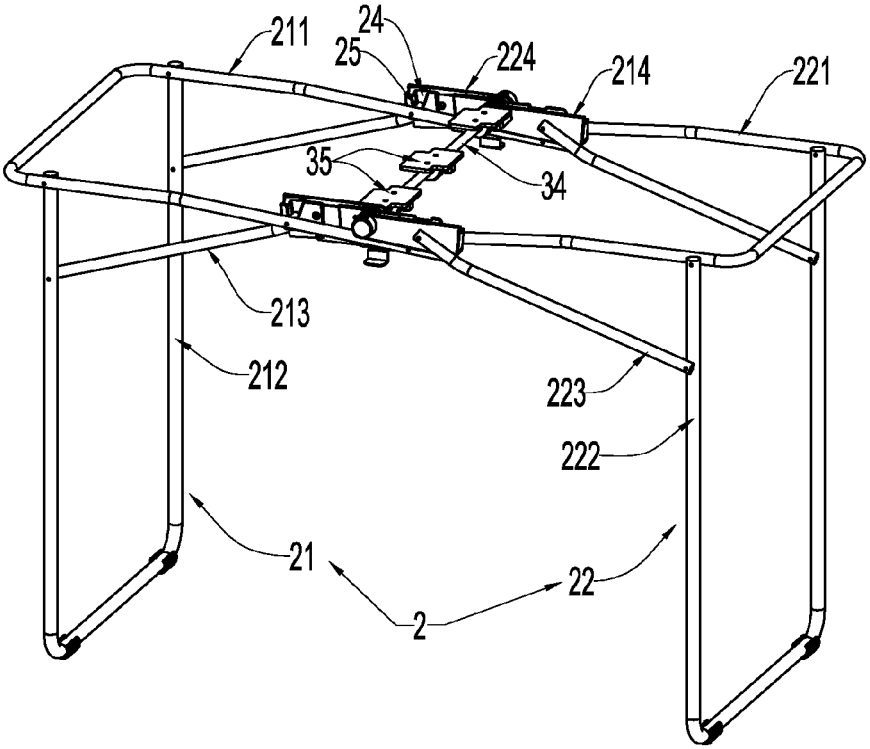
FIG. 8 is a space diagram of the table leg components of the outdoor folding table.
Figure 9:
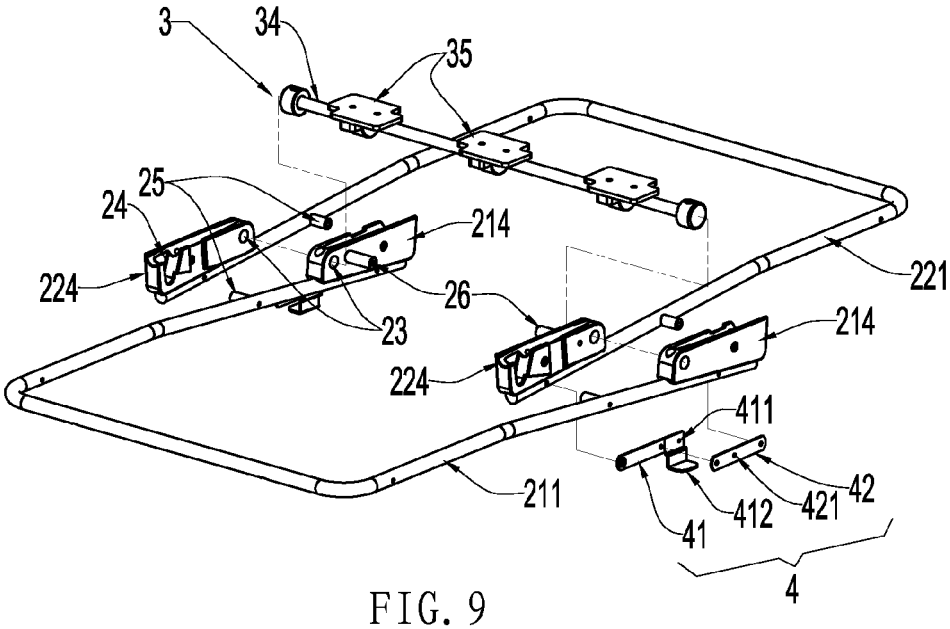
FIG. 9 is a decomposition diagram of the relationship between the table beams and through shafts.
Figure 10:
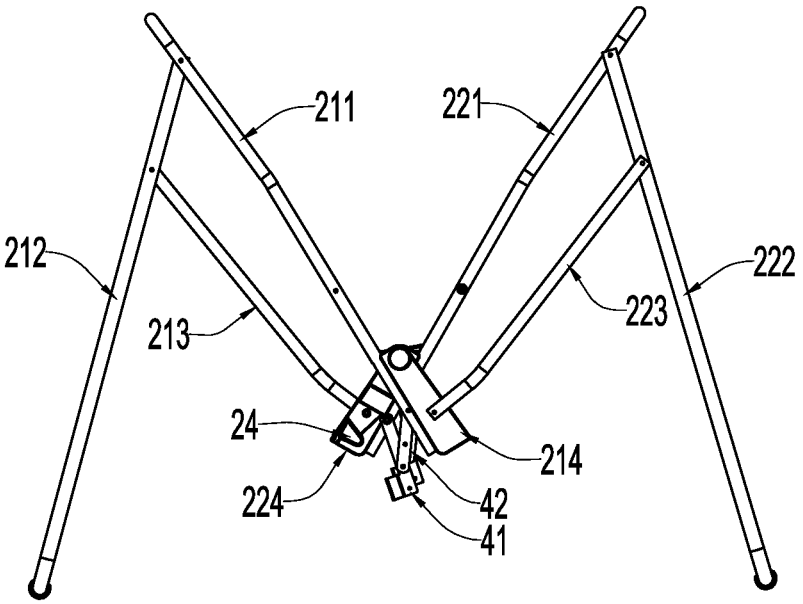
FIG. 10 is a side diagram of the folding process of the table leg components of the outdoor folding table.
Figure 11:
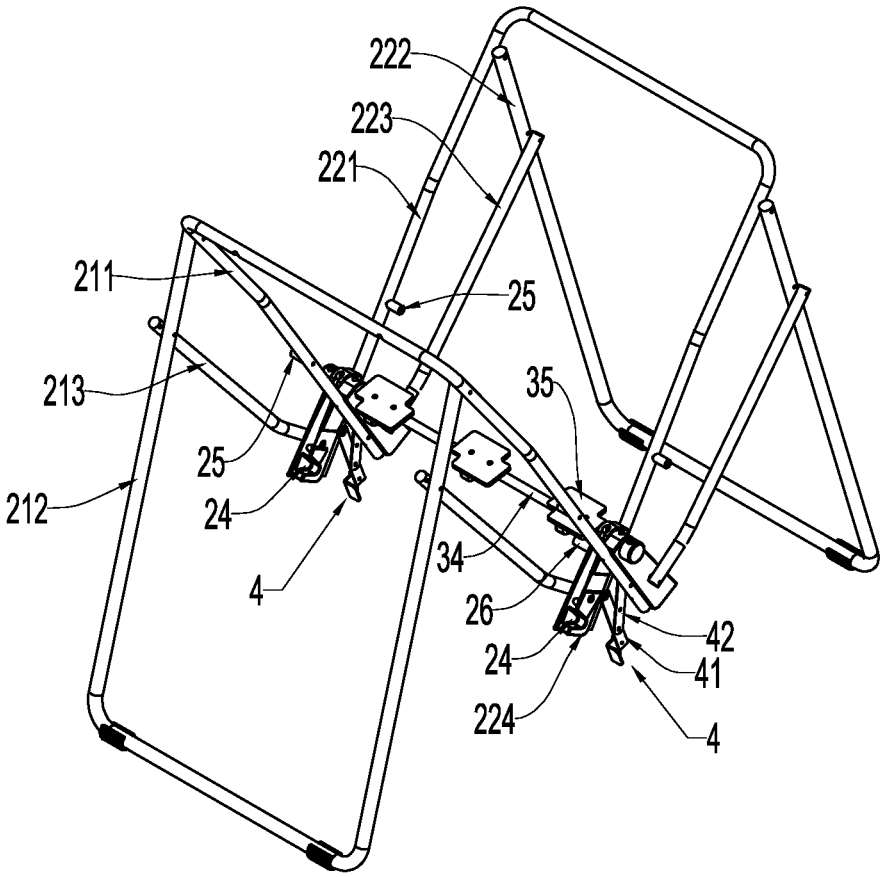
FIG. 11 is a space diagram of the folding process of the table leg components of the outdoor folding table.

Referring to FIG. 7 and FIG. 11, the shaft members 3 adopt the design of single shafts in the subject embodiment. The shaft members 3 are suitable for being adopted to outdoor folding tables with thinner table tops 1.

More particularly, the shaft holes 23 and the shaft grooves 24 with the upward openings are respectively formed in the first extending sections, namely the first plastic parts 214, and the second extending sections, namely the second plastic parts 224. The shaft members are through shafts 34, and the two ends of each shaft member respectively run through the shaft holes 23 of the first plastic parts 214 and the second plastic parts 224 on the two sides. Convex pins 25 are arranged at the positions, corresponding to the shaft grooves of the second plastic parts 224, of the first table beams 211 to form ascending limit of the second plastic parts 224. Convex pins 25 are arranged at the positions, corresponding to the shaft grooves of the first plastic parts 214, of the second table beams 221 to form ascending limit of the first plastic parts 214; crossed ascending limit is formed by the ascending limit of the second plastic parts 224 and the ascending limit of the first plastic parts 214.

Further, two to three trays 35 are fixed on the through shafts 34. One tray 35 is arranged close to the first plastic parts 214. Support pins 26 are arranged on the side, facing the tray 35, at the tilting ends of the first plastic parts 214, and the table top 1 is unfolded in place to support one side of the tray 35 in virtue of the support pins 26. The other tray 35 is arranged close to the second plastic parts 224. Support pins 26 are arranged on the side, facing the tray 35, at the tilting ends of the second plastic parts 224. The table top 1 is unfolded in place to support the other side of the tray 35 in virtue of the support pins 26. During the unfolding and tilting process of the first plastic parts 214 and the second plastic parts 224, the trays are centralized and also support the back of the contact part of the first table top 11 and the second table top 12, and the supporting role is strengthened for the thinner middle part of the table top without influencing the folding process.

In this embodiment, the first table beams 211, the first table legs 212 and the first inclined rods 213, as well as the second table beams 221, the second table legs 222 and the second inclined rods 223 are respectively machined and formed by standard rods. In particular, the first table beams 211 and the first table legs 212 as well as the second table beams 221 and the second table beams 222 are respectively bent U-shaped rods, so that the association strength of the table legs on the two sides is improved. Moreover, a complete table top frame can further be formed by the first table beams 211 and the second table beams 221 and is associated with the support of the tray 35 in the middle, and the support for the periphery of the first table top 11 and the periphery of the second table top 12 is formed, so that the bearing capacity of the table top is improved, and is it important for portable outdoor folding tables, and the portable table top is suitably fixed on the table beams.

In the two above-mentioned embodiments, the shaft holes 23 and the shaft grooves 24 can be conveniently formed and molded in the first plastic parts 214 and the second plastic parts 224, and the two embodiments are preferable schemes due to the characteristics of small fit clearance between the first plastic parts 214 and the second plastic parts 224 and small deflection allowance during the unfolding and folding processes. In the schemes, the first table beams 211 and the second table beams 221 can be independent components, and can also be reinforcing ribs on the two sides of the table top. However, the first table beams 211 and the second table beams 221 can extend to form the first plastic parts 214 and the second plastic parts 224, namely the first extending sections and the second extending sections. In the structure, the first extending sections and the second extending sections need to be machined necessarily, and the shaft holes and the shaft grooves with required shapes can be machined.

Third Embodiment

Figure 12:
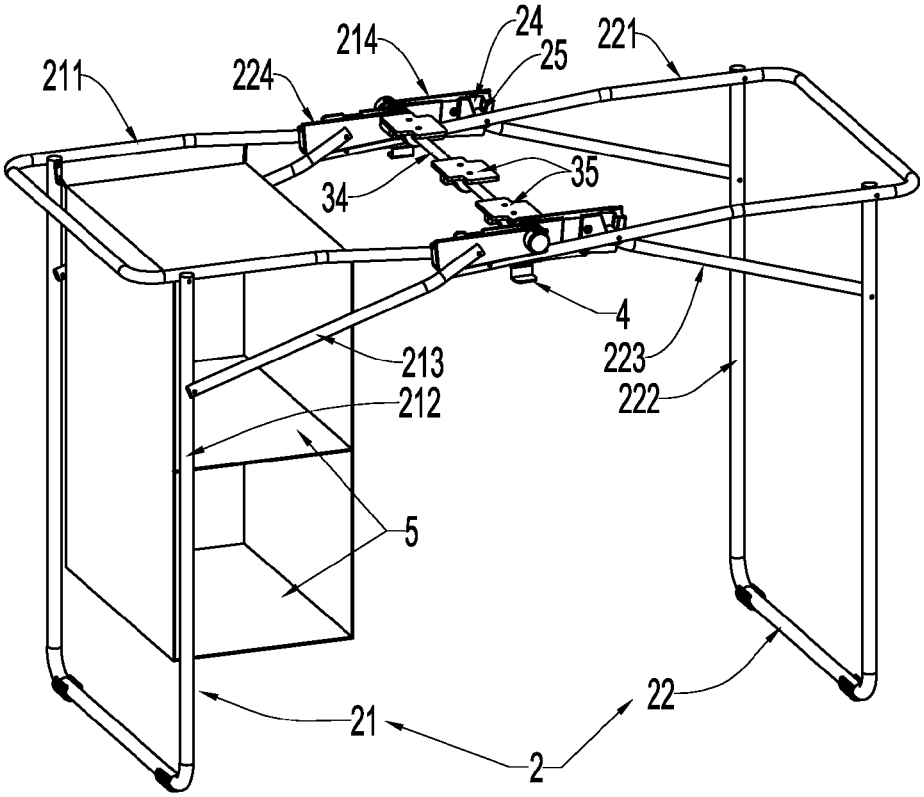
FIG. 12 is a space diagram of the table leg components with the storage hanging bag.
Figure 13:
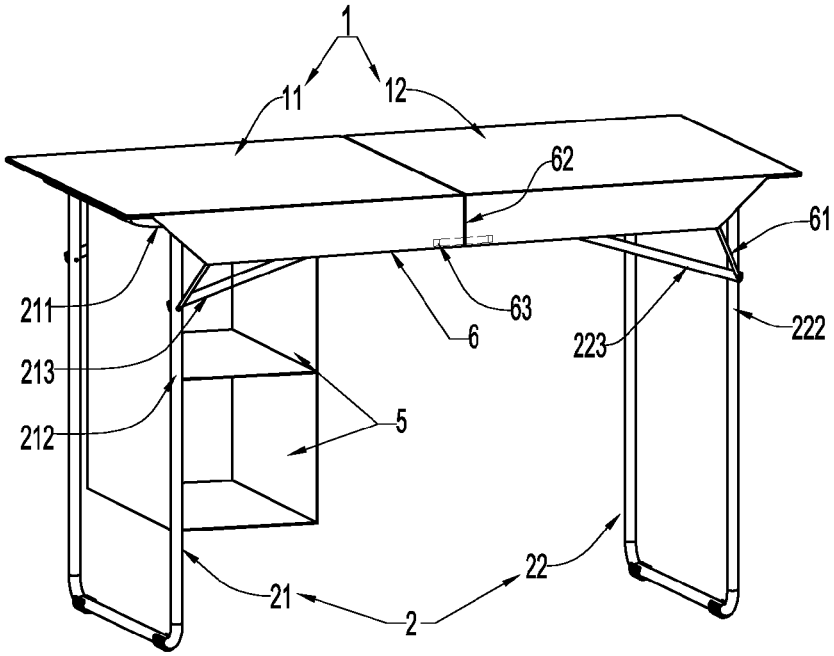
FIG. 13 is a space diagram of a folding office table.

Referring to FIG. 12 and FIG. 13, for extensive use of a folding office table, a folding storage hanging bag 5 hangs on the lower side of the first table beams 211, and serves as a side cabinet of an office table for placing articles such as books to provide a temporary office and reading table. The storage hanging bag 5 is formed by processing flexible shell fabrics such as oxford fabric, which can be folded freely along with the table legs, and does not occupy too much space.

The hanging of the storage hanging bag 5 can be completed in virtue of four corners hanging on the first table beams 211 or two parallel rod pieces fixed on the first table beams 211, the two parallel rod pieces pass through the two sides of the storage hanging bag 5 to form balanced support. Alternatively two corners of the storage hanging bag 5 on one side hang on the hinge joints of the first table legs 212 and the first table beams 211 through two hooks, and the other side of the storage hanging bag 5 hangs on the first table beams 211 in virtue of a rod piece.

In the decoration of the table, the shell fabric forming the table top 1 can extend to the two sides to form a skirt edge 6, two corners of each skirt edge 6 are tied on the first table leg 212 and the second table leg 222 through woven tapes 6, and a tight decorative effect is formed after the table top is unfolded. Moreover, a crack 62 is formed in each skirt edge 6 corresponding to the joint of the first table top 11 and the second table top 12. Each skirt edge 6 is tensioned through an elastic band 63 (an imaginary line shown in the figure). The cracks 62 can be appropriately opened during the folding process of the table top so as to successfully achieve the folding of the table. The way of manufacturing the skirt edges 6 is also suitable for the first embodiment and the second embodiment.

Figure 14:
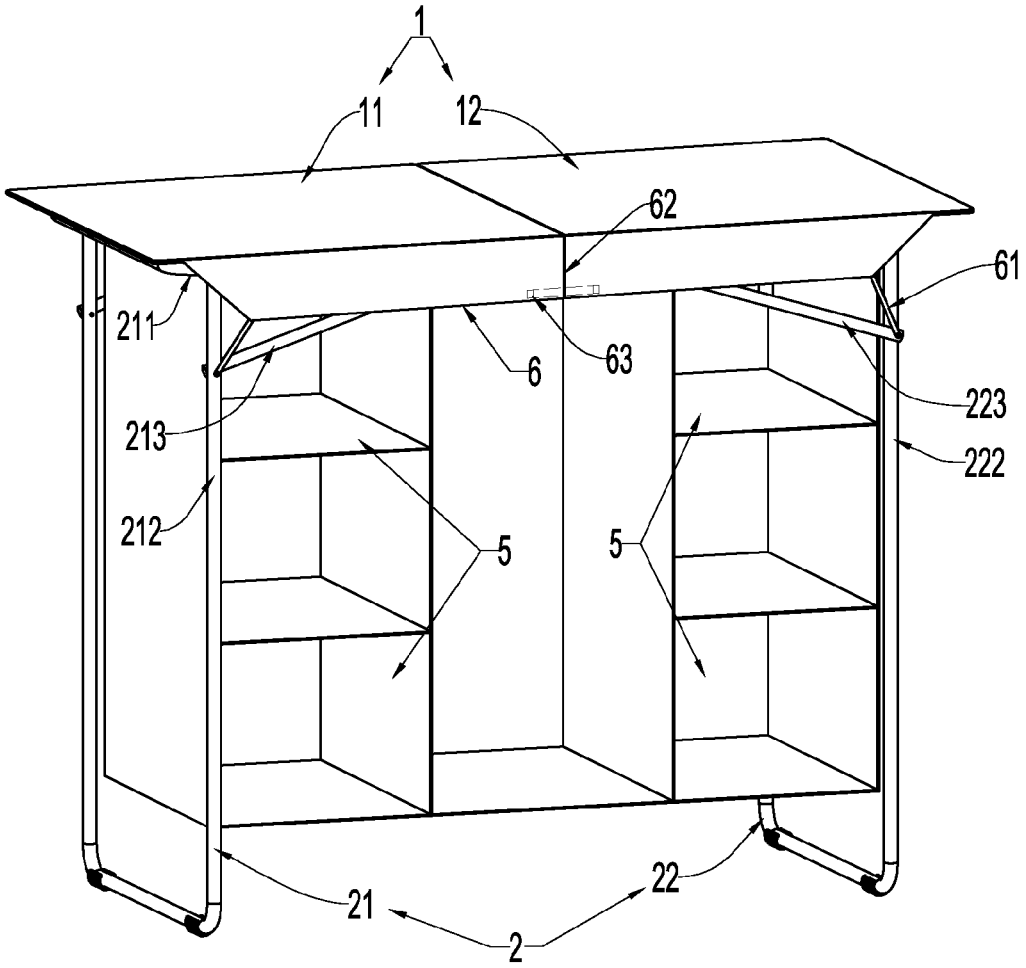
FIG. 14 is a space diagram of a folding low cabinet.

Referring to FIG. 14, for the extensive use of a folding low cabinet, namely the utilization of the folding table scheme, a low cabinet can be extended by increasing the heights of the table legs. In the structure, folding storage hanging bags 5 hang on the lower sides of the first table beams 211 and the second table beams respectively, then the bottoms of the two storage hanging bags 6 are connected to form a clothes hanging space in the middle. Additionally, multi-layer clothes storage spaces can be formed by the storage hanging bags 5 on the two sides so as to sufficiently utilize the idle space of the table legs. Moreover, the top surface of the low cabinet is also naturally formed by the top face 1, and can also provide an article storage table surface. The processing of other structures is similar to FIG. 13.

We claim:

1. A folding table, comprising:

a first table top (11) and a second table top (12) which can move between a folding position and an unfolding position; as well as a first table leg component (21) for supporting the first table top (11) and a second table leg component (22) for supporting the second table top (12); characterized in that the first table leg component (21) consists of same or symmetrical structures of parts distributed on the two sides of the first table top (11) to support the first table top (11), and comprises first table beams (211), first table legs (212) and first inclined rods (213) for positioning and supporting the first table top (11);

the second table leg component (22) consists of same or symmetrical components of parts distributed on the two sides of the second table top (12) to support the second table top (12), and comprises second table beams (221), second table legs (222) and second inclined rods (223) for positioning and supporting the second table top (12);

the first table beams (211) and the second table beams (221) are mutually staggered, the first table beams (211) extend towards one side of each of the second table beams (221) to form first extending sections, and the second table beams (221) extend towards one side of each of the first table beams (211) to form second extending sections, the first extending sections and the second extending sections at the staggered positions are hinged through shaft members (3);

the upper ends of the first table legs (212) are hinged onto the first table beams (211), one end of each of the first inclined rods (213) is hinged onto the first table legs (212), and the other ends of the first inclined rods (213) are hinged to the ends of the second extending sections; a first set of four-link mechanisms composed of the first table beams (211), a part of the first table legs (212), the first inclined rods (213) and the second extending sections are unfolded in place to support the first table top (11) in virtue of the second extending sections and the first table beams (211), and the first table leg component (21) is folded to the back of the first table top (11) at the folding position;

the upper ends of the second table legs (222) are hinged onto the second table beams (221), one end of each of the second inclined rods (223) is hinged onto the second table legs (222), and the other ends of the second inclined rods (223) are hinged to the ends of the first extending sections; a second set of four-link mechanisms composed of the second table beams (221), a part of the second table legs (222), the second inclined rods (223) and the first extending sections are unfolded in place to support the second table top (12) in virtue of the first extending sections and the second table beams (211), and the second table lea component (22) is folded to the back of the second table top (12) at the folding position, characterized in that the first extending sections and the second extending sections are plastically molded respectively, correspondingly called first plastic parts (214) and second plastic parts (224) shaft holes (23) and shaft grooves (24) with upward openings are respectively formed in the first plastic parts (214) and the second plastic parts (224);

wherein each shaft member (3) is of a double-shaft structure, and comprises a first shaft (31) and a second shaft (32) which are connected through a connecting shaft seat (33)

the ends of the first shaft (31) are inserted in the shaft holes (23) of the first plastic parts (214), and the first shaft (31) can flexibly enter the shaft grooves (24) of the second plastic parts (224) partially to form ascending limit of the second plastic parts (224); and the second shaft (32) is inserted in the shaft holes (23) of the second plastic parts (224), and the second shaft (32) can flexibly enter the shaft grooves (24) of the first plastic parts (214) partially to form ascending limit of the first plastic parts (214).

2. The folding table according to claim 1, characterized in that the first shafts (31) and the second shafts (32) of the shaft members (3) are respectively through shafts, the shaft members (3) are provided with at least two connecting shaft seats (33), the first shaft (31) runs through the first plastic parts (214) on the two sides, and the second shaft (32) runs through the second plastic parts (224) on the two sides.

3. The folding table according to claim 1, characterized in that the first extending sections and the second extending sections are plastically molded respectively, correspondingly called the first plastic parts (214) and the second plastic parts (224)

the shaft holes (23) and the shaft grooves (24) with the upward openings are respectively formed in the first plastic parts (214) and the second plastic parts (224)

the shaft members (3) are through shafts, and the two ends of each shaft member (3) respectively run through the shaft holes (23) of the first plastic parts (214) and the second plastic parts (224) on the two sides convex pins are arranged at the positions, corresponding to the shaft grooves (24) of the second plastic parts (224), of the first table beams (211) to form ascending limit of the second plastic parts (224), and convex pins are arranged at the positions, corresponding to the shaft grooves (24) of the first plastic parts (214), of the second table beams (221) to form ascending limit of the first plastic parts (214).

4. The folding table according to claim 3, characterized in that two to three trays (35) are fixed on the through shafts (34), one tray (35) is arranged adjacent to the first plastic parts (214), support pins (26) are arranged on the side, facing the tray (35), at the tilting ends of the first plastic parts (214), and the table top is unfolded in place to support one side of the tray (35) in virtue of the support pins (26)

the other tray (35) is arranged adjacent to the second plastic parts (224), support pins (26) are arranged on the side, facing the tray (35), at the tilting ends of the second plastic parts (224), and the table top is unfolded in place to support the other side of the tray (35) in virtue of the support pins (26)

during the unfolding and tilting process of the first plastic parts (214) and the second plastic parts (224), the trays (35) are centralized and also support the back of the contact part of the first table top (11) and the second table top (12).

5. The folding table according to claim 3, characterized in that a lock catch component (4) is arranged between each first plastic part (214) and each second plastic part (224), the lock catch components (4) are unfolded in place on the first table top (11) and the second table top (12) to form an opposite pulling structure for the first plastic parts (214) and the second plastic parts (224), and the first plastic parts (214) and the second plastic parts (224) are prevented from being staggered in horizontal direction.

6. The folding table according to claim 5, characterized in that each lock catch component (4) comprises an operating piece (41) with a handle (412) and a connecting piece (42), one end of the operating piece (41) is hinged onto the second plastic part (224), the middle part of the operating piece (41) is hinged with one end of the connecting piece (42), and a convex point (411) is arranged on the side, facing the connecting piece, at the other end of the operating piece (41)

one end of the connecting piece (42) is hinged onto the first plastic part (214), the other end of the connecting piece (42) is hinged onto the operating piece (41), and a buckle hole (421) corresponding to the convex point (411) on the operating piece (41) is arranged at the middle part of the connecting piece (42)

the table top is unfolded in place, and the handles (412) on the two sides are lifted simultaneously, so that the convex points (411) on the operating pieces (41) slip into the buckle holes (421) to form a lock catch relationship.

7. The folding table according to claim 1 or 3, characterized in that the first table beams (211) are a part of the first table top (11), and are reinforcing ribs distributed on the two sides of the back of the first table top (11)

the second table beams (221) are a part of the second table top (12), and are reinforcing ribs distributed on the two sides of the back of the second table top (12).

8. The folding table according to claim 1, characterized in that the first table legs (212) and the second table legs (222) are bent U-shaped rod pieces, and the two ends of each of the U-shaped rod pieces are correspondingly hinged onto the first table beams (211) on the two sides of the first table top (11) and the second table beams (221) on the two sides of the second table top (12).

9. The folding table according to claim 1, characterized in that a folding storage hanging bag (5) hangs on the lower side of the first table beams (211), or folding storage hanging bags (5) hang on the lower sides of the first table beams (211) and the second table beams (221).

10. The folding table according to claim 1, characterized in that a folding storage hanging bag (5) hangs on the lower side of the first table beams (211), or folding storage hanging bags (5) hang on the lower sides of the first table beams (211) and the second table beams (221).

11. The folding table according to claim 3, characterized in that a folding storage hanging bag (5) hangs on the lower side of the first table beams (211), or folding storage hanging bags (5) hang on the lower sides of the first table beams (211) and the second table beams (221).

12. The folding table according to claim 1, characterized in that a lock catch component (4) is arranged between each first plastic part (214) and each second plastic part (224), the lock catch components (4) are unfolded in place on the first table top (11) and the second table top (12) to form an opposite pulling structure for the first plastic parts (214) and the second plastic parts (224), and the first plastic parts (214) and the second plastic parts (224) are prevented from being staggered in horizontal direction.

* * * * *